US008702401B2

(12) United States Patent
Horng

(10) Patent No.: US 8,702,401 B2
(45) Date of Patent: Apr. 22, 2014

(54) COOLING FAN AND HOUSING THEREOF

(75) Inventor: Alex Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 250 days.

(21) Appl. No.: 13/083,653

(22) Filed: Apr. 11, 2011

(65) Prior Publication Data

US 2012/0207618 A1 Aug. 16, 2012

(30) Foreign Application Priority Data

Feb. 15, 2011 (CN) ..... 2011 1 0038211

(51) Int. Cl.
*F04B 35/04* (2006.01)

(52) U.S. Cl.
USPC ..... 417/423.14

(58) Field of Classification Search
None
See application file for complete search history.

(56) References Cited

U.S. PATENT DOCUMENTS

| | | | | |
|---|---|---|---|---|
| 6,132,170 | A * | 10/2000 | Horng | 415/178 |
| 6,655,929 | B2 | 12/2003 | Hsieh | |
| 7,161,315 | B2 * | 1/2007 | Hsu | 318/280 |
| 7,477,027 | B1 * | 1/2009 | Corbett et al. | 318/257 |
| 2003/0142476 | A1 | 7/2003 | Tomioka et al. | |
| 2008/0253083 | A1 * | 10/2008 | Okutsu | 361/687 |
| 2010/0098535 | A1 | 4/2010 | Sakai et al. | |
| 2010/0254826 | A1 | 10/2010 | Streng et al. | |
| 2011/0027137 | A1 * | 2/2011 | Kim et al. | 422/186.3 |
| 2011/0097195 | A1 * | 4/2011 | Horng et al. | 415/121.2 |

FOREIGN PATENT DOCUMENTS

| | | | | |
|---|---|---|---|---|
| DE | 0215476 | A2 * | 3/1987 | B24B 55/10 |
| JP | 2008-140943 | * | 6/2008 | H01L 23/467 |
| JP | 2008140943 | A * | 6/2008 | |
| TW | I229254 | | 3/2005 | |
| TW | M366611 | U1 | 10/2009 | |
| TW | M394386 | U1 | 12/2010 | |

OTHER PUBLICATIONS

Translation of EP 0215476 A2, Mar. 1987, Fabritius.*
Translation of JP 2008-140943, Jun. 2008, Saito.*
JP 2008140943 A translation ,Jun. 2008 ,Japan ,Saito, Yoshihiro.*

* cited by examiner

*Primary Examiner* — Charles Freay
*Assistant Examiner* — Amene Bayou
(74) *Attorney, Agent, or Firm* — Alan Kamrath; Kamrath IP Lawfirm, P.A.

(57) ABSTRACT

A cooling fan includes a sidewall coupled to a base of a housing and defining a compartment. The housing includes an air inlet, an air outlet, and a dust channel. The air inlet, the air outlet, and the dust channel are in communication with the compartment. An impeller is rotatably coupled to a stator coupled to the base. A control element includes a driving circuit electrically connected to the stator and a rotating direction control circuit electrically connected to the driving circuit. The air outlet and the dust channel separate an inner periphery of the sidewall into first and second guiding wall sections. The first guiding wall section has a guiding portion contiguous to the dust channel. A first spacing between the guiding portion and a center of the impeller is not larger than a second spacing between the second guiding wall section and the center of the impeller.

20 Claims, 7 Drawing Sheets

COOLING FAN AND HOUSING THEREOF

BACKGROUND OF THE INVENTION

1. Field of the Invention

The present invention relates to a cooling fan and a housing thereof and, more particularly, to a cooling fan with an automatic dust removing function and a housing thereof.

2. Description of the Related Art

Conventional cooling fans generally include a housing having an air inlet and an air outlet. An impeller is rotatably mounted in the housing and driven by a driving unit also mounted in the housing to draw in ambient air via the air inlet. The air currents drawn into the housing are concentrated before exiting the air outlet to a heat source in an electronic product. The temperature of the heat source during operation is, thus, lowered. However, dust carried by the air currents is liable to accumulate inside the housing at the air inlet, the air outlet, the blades of the impeller, etc., adversely affecting the air input and/or air output and, thus, adversely affecting the heat dissipating effect.

FIG. 1 shows a cooling fan 9 including a housing 91 having an air inlet 911 and an air outlet 912. An impeller 92 is mounted in the housing 91. A plurality of fins 93 is mounted in the air outlet 912. Air currents can be driven by the impeller 92 into the housing 91 via the air inlet 911. The air currents pass through the fins 93 and the air outlet 912 to a heat source of an electronic product. An example of such a cooling fan 9 is disclosed in Taiwan Patent No. I229254. However, dust is liable to accumulate inside the housing 91 after a period of time of use. Since the spacing between the fins 93 is small, the dust is liable to accumulate between the fins 93, significantly reducing the air output and requiring regular manual cleaning.

SUMMARY OF THE INVENTION

An objective of the present invention is to provide a cooling fan that can remove dust automatically.

Another objective of the present invention is to provide a cooling fan with reliable input and output of air by automatically removing dust.

A further objective of the present invention is to provide a housing for a cooling fan to reliably guide the air currents to expel the dust to the environment during the automatic dust removing operation.

Still another objective of the present invention is to provide a housing for a cooling fan to prevent the dust to be removed from flowing back into an interior of the housing.

The present invention fulfills the above objectives by providing, in a preferred aspect, a cooling fan including a housing having a base and a sidewall coupled to the base. The sidewall defines a compartment. The housing further includes an air inlet, an air outlet, and a dust channel. The air inlet, the air outlet, and the dust channel are in communication with the compartment. A stator is coupled to the base of the housing. An impeller is rotatably coupled to the stator. A control element includes a driving circuit electrically connected to the stator and a rotating direction control circuit electrically connected to the driving circuit. The air outlet and the dust channel separate an inner periphery of the sidewall into a first guiding wall section and a second guiding wall section. The first guiding wall section has a guiding portion contiguous to the dust channel. A first spacing between the guiding portion and a center of the impeller is not larger than a second spacing between the second guiding wall section and the center of the impeller.

In another preferred aspect, a cooling fan includes a housing having a base and a sidewall coupled to the base. The sidewall defines a compartment. A shaft seat is provided in the compartment and is adapted to couple with an impeller. The housing further includes an air inlet, an air outlet, and a dust channel. The air inlet, the air outlet, and the dust channel are in communication with the compartment. The air outlet and the dust channel separate an inner periphery of the sidewall into a first guiding wall section and a second guiding wall section. The first guiding wall section has a guiding portion contiguous to the dust channel. A first spacing between the guiding portion and a center of the impeller is not larger than a second spacing between the second guiding wall section and the center of the impeller.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
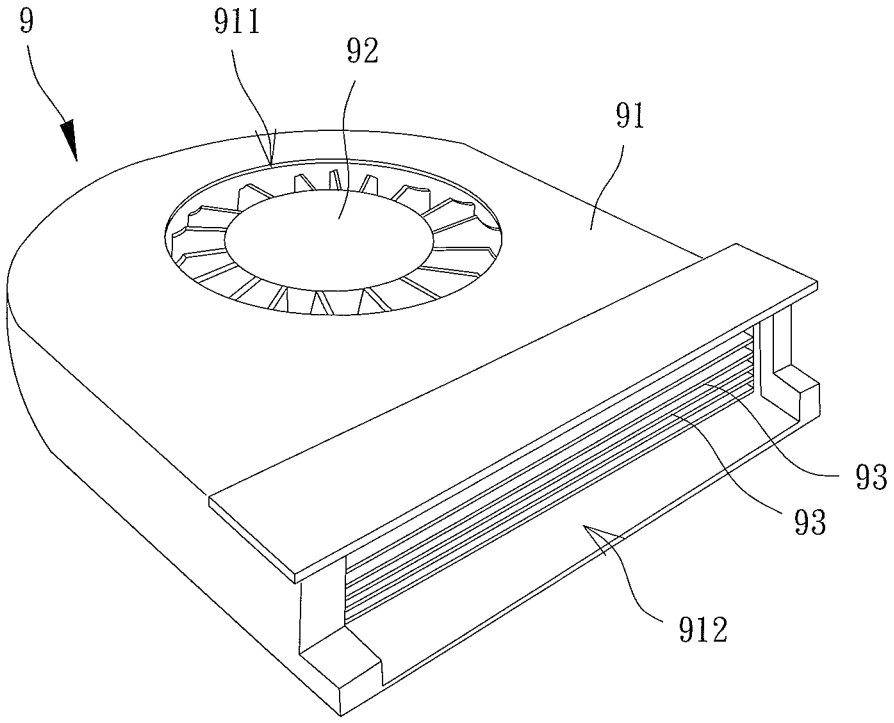
FIG. 1 PRIOR ART
FIG. 1 shows a perspective view of a conventional cooling fan.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "end", "portion", "section", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
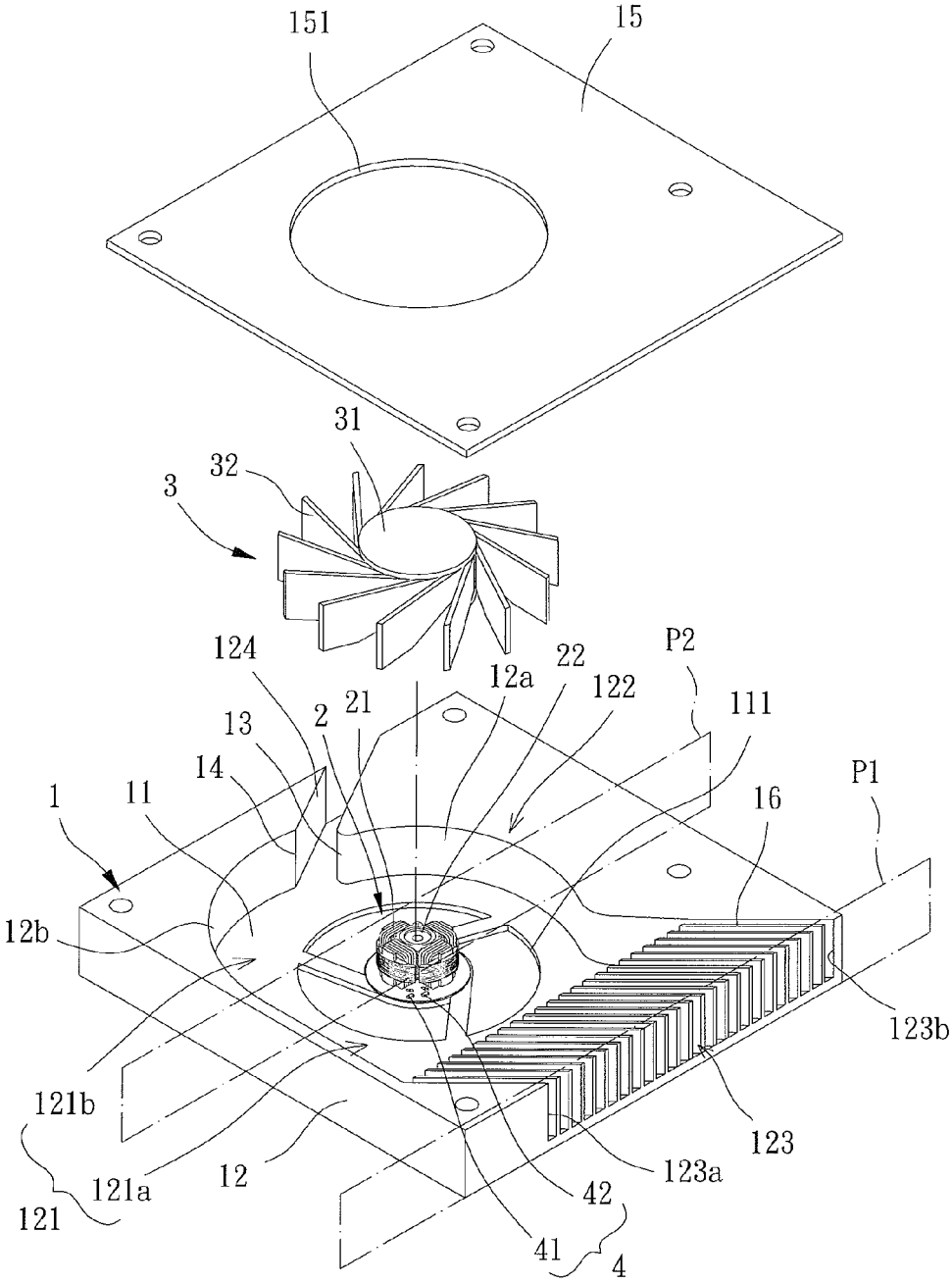
FIG. 2 shows an exploded, perspective view of a cooling fan of an embodiment according to the present invention.

With reference to FIG. 2, a cooling fan of an embodiment according to the present invention generally includes a housing 1, a stator 2, an impeller 3, and a control element 4. The housing 1 can be mounted in a desired location of an electronic product, such as a face of a main board inside a computer. The stator 2 is mounted in the housing 1. The impeller 3 is mounted in the housing 1 and rotatably coupled to the stator 2. The control element 4 controls the impeller 3 to rotate in a first direction for generating a sufficient amount of air for cooling purposes or to rotate in a reverse, second direction for dust removing purposes by cooperating with the structure of the housing 1.

Specifically, the housing 1 includes a base 11 and a sidewall 12 coupled to a side of the base 11 and defining a compartment 121. The sidewall 12 includes an air inlet 122 and an air outlet 123 both in communication with the compartment 121. The sidewall 12 further includes a dust channel 124 in communication with the compartment 121. It can be appreciated that the sidewall 12 can include more than one dust channel 124.

Figure 3:
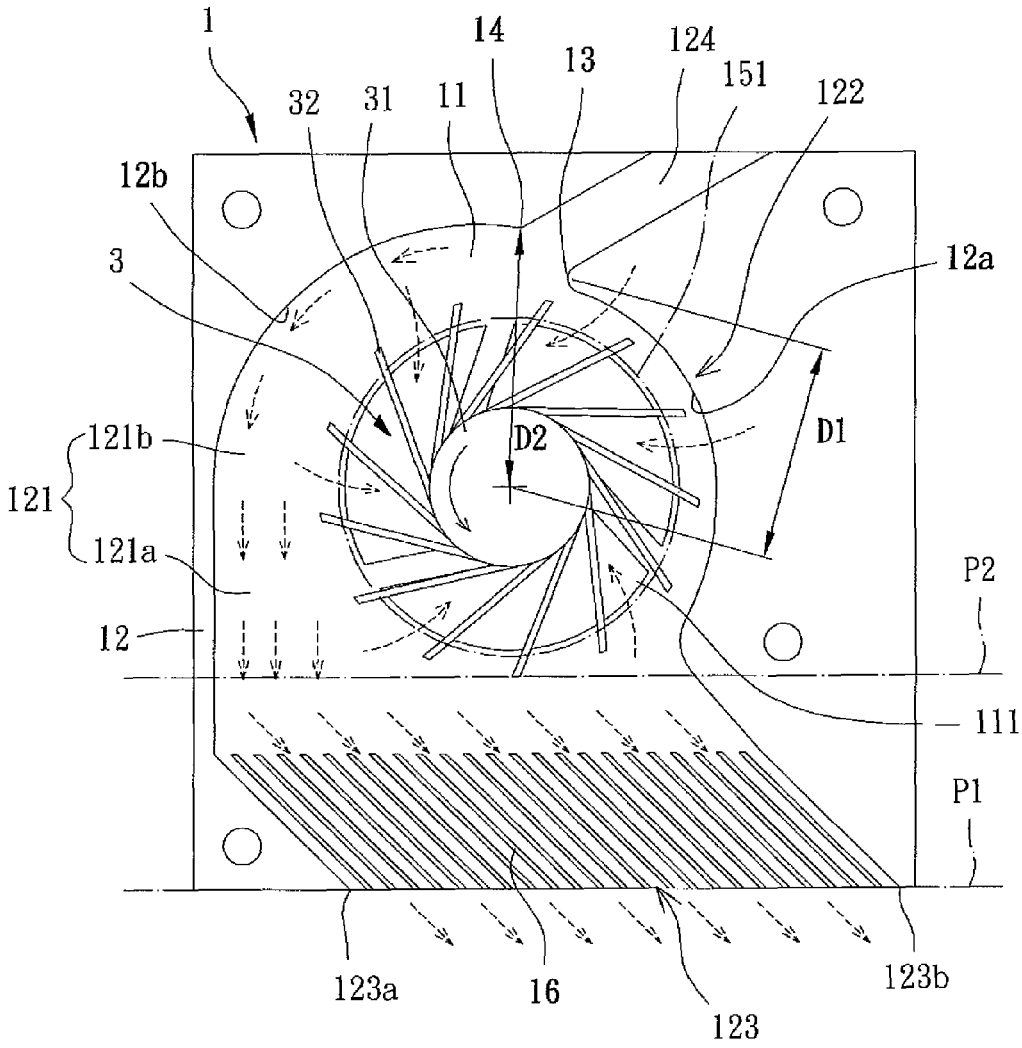
FIG. 3 shows a top view of the cooling fan of FIG. 2, with a cover of the cooling fan removed and with the cooling fan rotating in a direction for cooling purposes.

More specifically, the air outlet 123 and the dust channel 124 separate an inner periphery of the sidewall 12 into a first guiding wall section 12*a* and a second guiding wall section 12*b*. The first guiding wall section 12*a* has a guiding portion 13 contiguous to the dust channel 124. With reference to FIG. 3, a first spacing D1 between the guiding portion 13 and a center of the impeller 3 is not larger than a second spacing D2 between the second guiding wall section 12*b* and the center of the impeller 3. Preferably, the first spacing D1 is smaller than the second spacing D2. Preferably, the second spacing D2 is the shortest distance between the second guiding wall section 12*b* and the center of the impeller 3.

The stator 2 is mounted to the base 11 of the housing 1 and includes a coil unit 21 and a shaft seat 22. The coil unit 21 is mounted around an outer periphery of the shaft seat 22. The shaft seat 22 can be formed with or mounted to the base 11.

The impeller 3 includes a hub 31 and a plurality of blades 32. The hub 31 is rotatably coupled to the shaft seat 22 of the stator 2. The blades 32 are coupled to an outer periphery of the hub 31. Since the impeller 3 is rotatably engaged with the shaft seat 22, the first spacing D1 is equal to the spacing between the guiding portion 13 and the center of the shaft seat 22, and the second spacing D2 is equal to the spacing between the second guiding wall section 12*b* and the center of the shaft seat 22.

The control element 4 includes a driving circuit 41 and a rotating direction control circuit 42. The driving circuit 41 is electrically connected to the coil unit 21 of the stator 2. The rotating direction control circuit 42 is electrically connected to the driving circuit 41. The driving circuit 41 and the rotating direction control circuit 42 can be packaged in the same integrated circuit. Furthermore, the control element 4 can be integrated into the housing 1. However, the control element 4 can be external to the housing 1 without adversely affecting control on the impeller 3.

In use of the cooling fan according to the present invention, the cooling fan is engaged with an electronic product with the air outlet 123 of the housing 1 facing a heat source of the electronic product that tends to generate heat during operation. The rotating direction control circuit 42 can send a rotating direction control signal to the driving circuit 41 to actuate the coil unit 21 of the stator 2 to create a magnetic field for driving the impeller 3 to rotate in the first direction (such as the counterclockwise direction in FIG. 3). Ambient air currents are drawn in via the air inlet 122. The air currents are concentrated by the impeller 3 before passing through the air outlet 123 to the heat source of the electronic product for cooling purposes.

Figure 4:
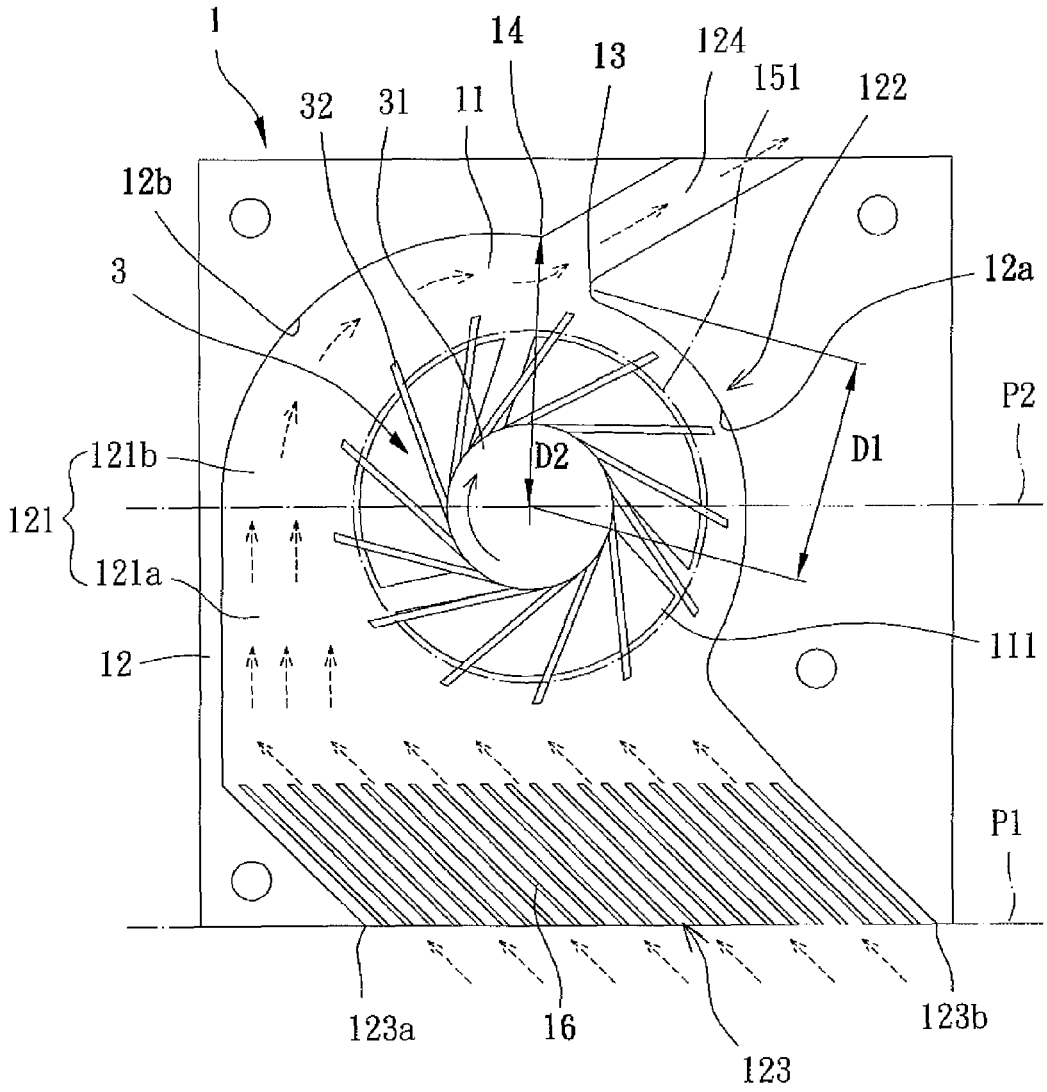
FIG. 4 shows a top view of the cooling fan of FIG. 2, with the cover of the cooling fan removed and with the cooling fan rotating in a reverse direction for dust removing purposes.

With reference to FIGS. 2 and 4, since dust is liable to accumulate inside the housing 1 (such as at the air inlet 122, the air outlet 123, the blades 32 of the impeller 3, etc.) after a period of time of use, the rotating direction control circuit 42 can send another rotating direction control signal to the driving circuit 41 to actuate the coil unit 21 of the stator 2 to create a magnetic field for driving the impeller 3 to rotate in the reverse, second direction (such as the clockwise direction in FIG. 4). Ambient air currents are drawn in via the air inlet 122 and then exit the housing 1 via the dust channel 124 (FIG. 4). Thus, the dust accumulated inside the housing 1 can be expelled from the housing 1 to the environment together with the air currents, eliminating accumulation of the dust. Thus, the overall air input and output are not adversely affected, effectively enhancing the heat dissipating effect.

More specifically, the rotating direction control circuit 42 can control the timing of rotation of the impeller 3 in the clockwise or counterclockwise direction through the driving circuit 41. As an example, the cooling fan according to the present invention can be set that the impeller 3 rotates in the counterclockwise direction for a period of time (such as an hour or two) immediately after the cooling fan is turned on. Then, the impeller 3 is controlled to rotate in the clockwise direction for another period of time (such as 10 or 20 minutes) for automatic removal of dust. After the automatic dust removing operation, the impeller 3 is controlled to rotate in the counterclockwise direction for cooling purposes. In another example, the cooling fan according to the present invention can be set that the impeller 3 rotates in the clockwise direction for a period of time for automatic dust removing operation immediately after the cooling fan is turned on. Then, the impeller 3 is controlled to rotate in the counterclockwise direction for cooling purposes.

By controlling the impeller 3 to rotate in a reverse direction with the rotating direction control circuit 42 via the driving circuit 41, the cooling fan according to the present invention can automatically remove dust without adversely affecting the cooling function. Thus, accumulation of dust inside the housing 1 is eliminated to avoid adverse affect to the overall heat dissipating effect.

More importantly, when the impeller 3 rotates in the reverse direction and guides the air current drawn in via the air inlet 122 to the dust channel 124 along the second guiding walls section 12*b*, the dust accumulated in the housing 1 can be expelled from the housing 1 by the air currents. This is because the first spacing D1 of the housing 1 between the guiding portion 13 and the center of the impeller 3 is not larger than the second spacing D2. Thus, the dust to be cleaned is prevented from flowing back into the interior of the housing 1. Overall, by using the rotating direction control circuit 42 in cooperation with the dust channel 124, the cooling fan according to the present invention can automatically remove the dust while enhancing the heat dissipating effect, effectively prolonging the service life of the electronic product.

The cooling fan according to the present invention can incorporate additional features to perfect the functions. Particularly, with reference to FIGS. 2 and 3, the air outlet 123 of the housing 1 includes opposite first and second end edges 123*a* and 123*b*. The housing 1 defines a first plane P1 including the first and second end edges 123*a* and 123*b*. The impeller 3 defines a second plane P2. The second plane P2 can include a center of the hub 31 (FIG. 2) or can be tangential to the outermost margin of the impeller 3 adjacent to the air outlet 123 (FIG. 3). The second plane P2 is parallel to and spaced from the first plane P1. The compartment 121 is divided into an air outlet section 121*a* and a pressure accumulating section 121*b* by defining the first and second planes P1 and P2. The air outlet section 121*a* is located between the first and second planes P1 and P2. The pressure accumulating section 121*b* and the air outlet section 121*a* are located on opposite sides of the second plane P2. The air outlet 123 is located in the air outlet section 121*a*. The dust channel 124 is located in the pressure accumulating section 121*b*. Thus, the dust channel 124 is away from the air outlet 123. When the control element 4 controls the impeller 3 to rotate in the second direction, the impeller 3 can drive the air currents from the air outlet section 121*a* to the pressure accumulating section 121*b* more thoroughly, so that the dust accumulated inside the housing 1 can be smoothly removed together with the air currents exiting the dust channel 124 to the environment.

Figure 5:
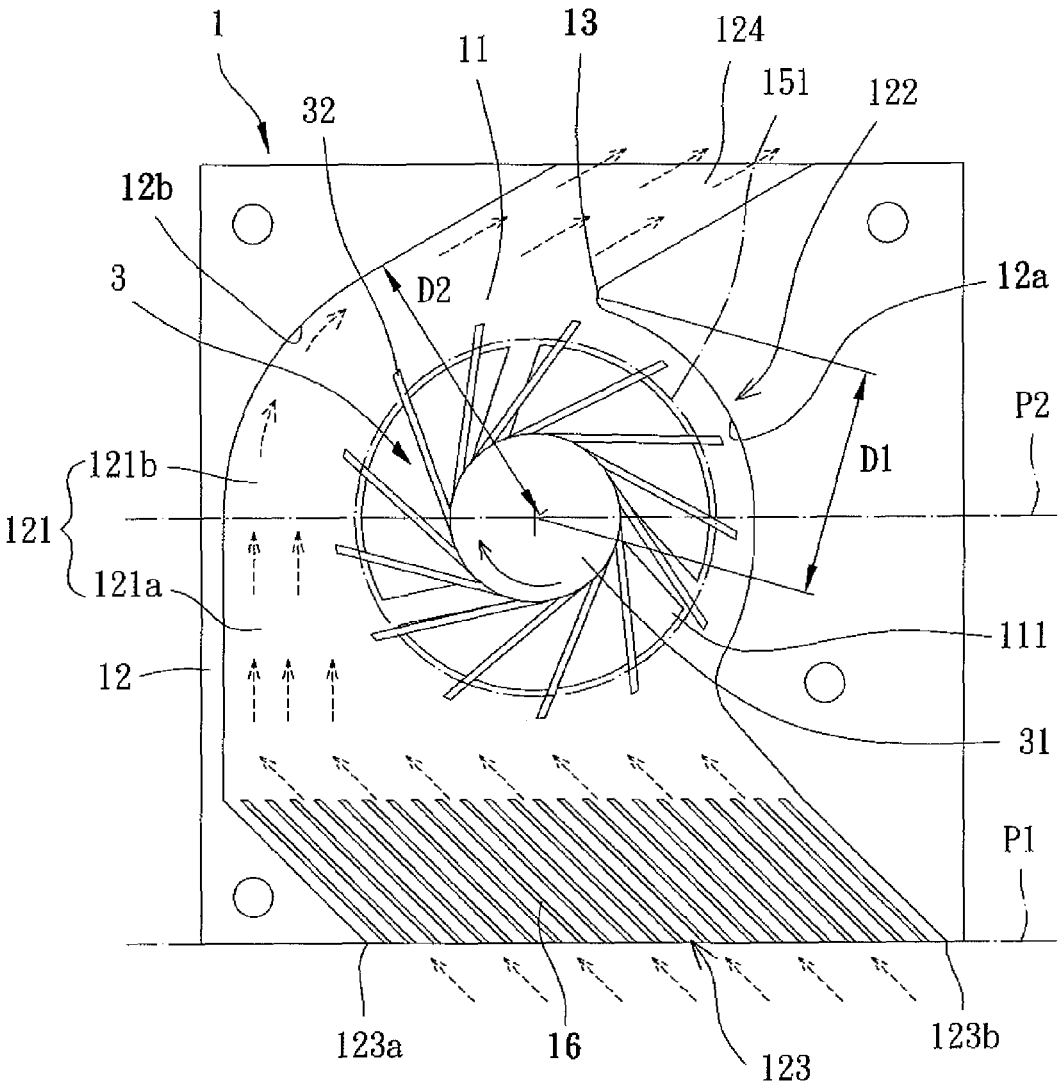
FIG. 5 shows a top view similar to FIG. 4, illustrating an example of the cooling fan having a dust channel at an acute angle to a reference plane.
Figure 6:
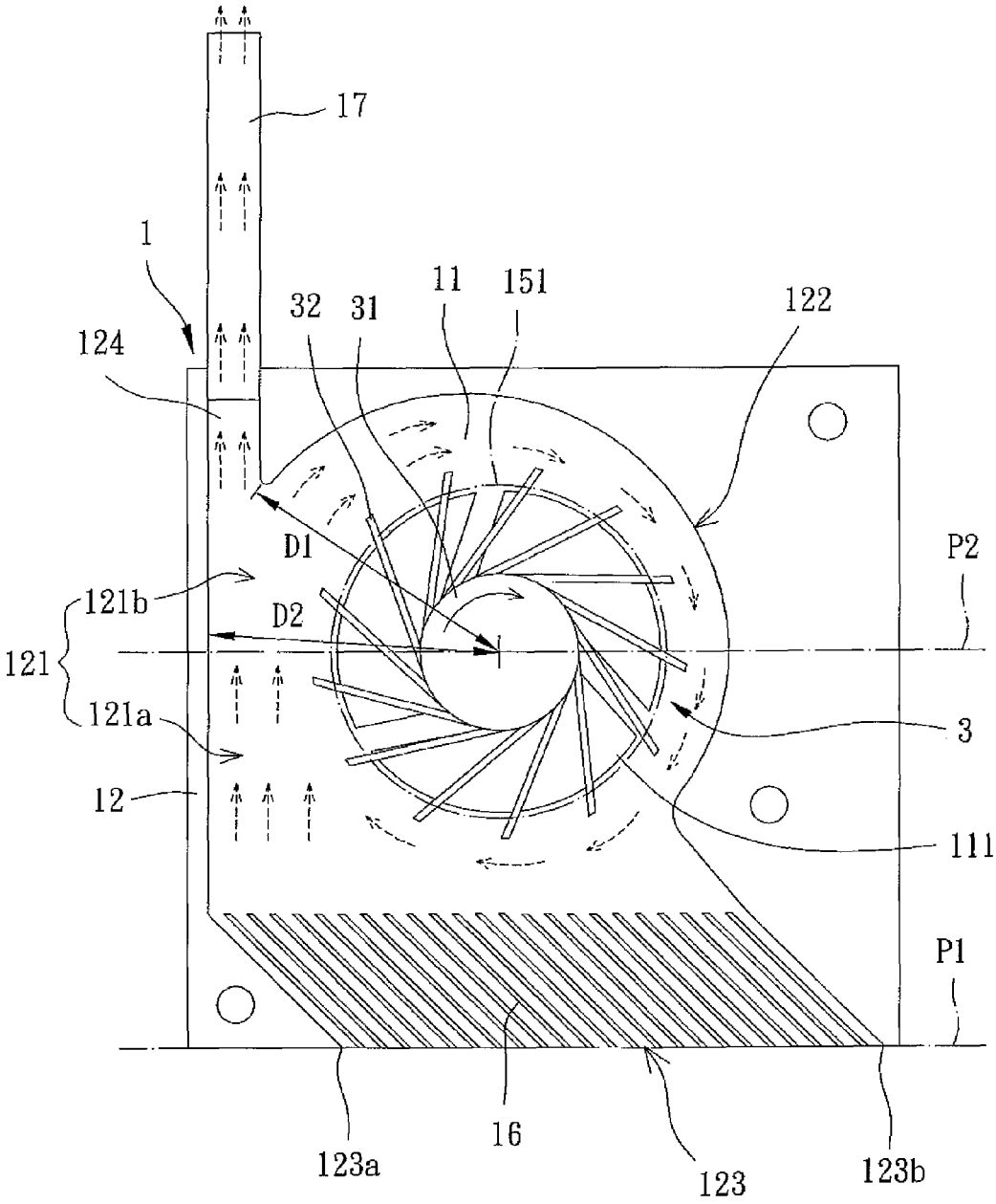
FIG. 6 shows a top view similar to FIG. 4, illustrating another example of the cooling fan having a dust channel perpendicular to the reference plane.
Figure 7:
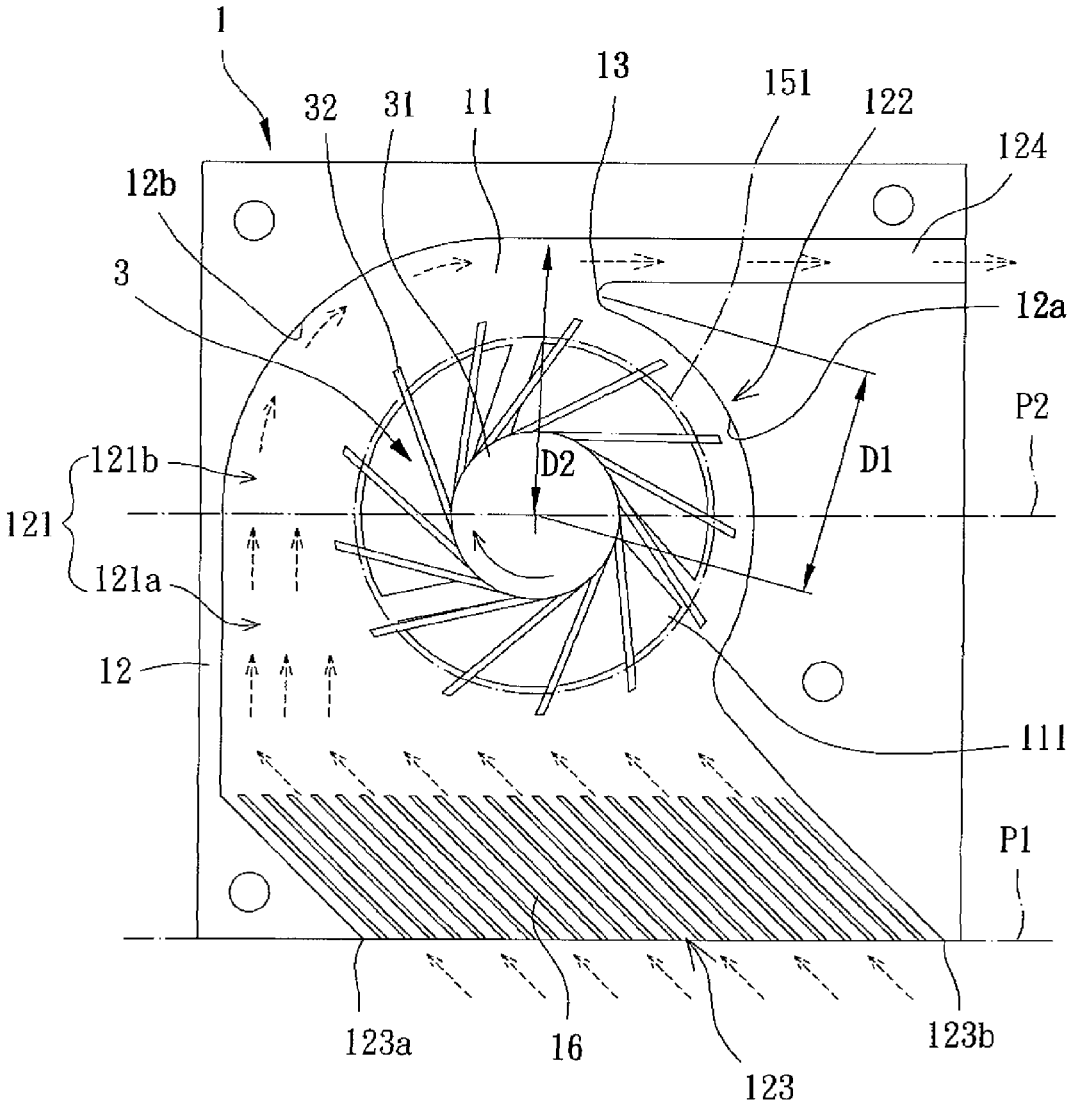
FIG. 7 shows a top view similar to FIG. 4, illustrating a further example of the cooling fan having a dust channel parallel to the reference plane.

The dust channel 124 can extend in a direction at an acute angle to the second plane P2 (FIG. 5), in a direction perpendicular to the second plane P2 (FIG. 6), or in a direction parallel to the second plane P2 (FIG. 7). It can be appreciated that the first spacing D1 is not larger than the second spacing D2 in these examples. The extending direction of the dust channel 124 is preferably related to the moving direction of the air currents driven by the impeller 3 rotating in the reverse direction for removing dust. In the example shown in FIG. 5, the dust channel 124 extends in a direction at an acute angle to the second plane P2 to reduce the resistance to the air currents that are driven by the impeller 3 to flow along the second guiding wall section 12*b* of the sidewall 12 into the dust channel 124, assuring a smooth dust removal operation. With reference to FIGS. 2 and 4, the second guiding wall section 12*b* can include a bend 14 contiguous to the dust channel 124 and having the minimal second spacing D2 to the center of the impeller 3.

With reference to FIGS. 2 and 3, a cover 15 can be mounted to the sidewall 12 of the housing 1. The cover 15 includes an opening 151 aligned with the air inlet 122. The cover 15 seals the compartment 121 except the air inlet 122, so that the air currents generated by the impeller 3 can enter the housing 1 via the opening 151 and the air inlet 122, providing a pressure increasing effect to smoothly guide the air currents to exit the air outlet 123.

With reference to FIGS. 2 and 3, the base 11 of the housing 1 can further include a plurality of auxiliary air inlets 111 aligned with the air inlet 122. The air currents generated by the impeller 3 can also enter the housing 1 via the auxiliary air inlets 111, increasing the air input.

With reference to FIGS. 2 and 3, a plurality of fins 16 can be formed in the air outlet 123. The fins 16 can be directly formed in the air outlet 123 or integrated as a heat sink mounted to the air outlet 123. Thus, when the housing 1 is coupled to the electronic product, the fins 16 can absorb the heat generated by the heat source of the electronic product, providing a further enhanced heat dissipating effect while the impeller 3 drives air currents through the air outlet 123.

With reference to FIG. 6, a dust guiding pipe 17 can be attached to the dust channel 124 for guiding the dust removed from the housing 1 to a position away from the housing 1, enhancing the dust removing effect.

In conclusion, the cooling fans according to the present invention can control the impeller 3 by the rotating direction control circuit 42 of the control element 4 via the driving circuit 41 to rotate in a reverse direction cooperating with the dust channel 124, allowing an automatic dust removal operation to effectively remove the dust accumulated in the housing 1 and, thus, providing a convenient dust removing operation. Since the dust can be removed automatically, the dust is less likely to accumulate in the housing 1 to an unexpected amount, effectively maintaining the air input and air output and enhancing the heat dissipating effect.

Furthermore, by providing the housing 1 including a guiding portion 13 having the first spacing D1 to the center of the impeller 3 not larger than the second spacing D2, the air currents carrying the dust can be reliably guided and expelled from the housing 1 during the dust removing operation while preventing the dust from flowing back into the interior of the housing 1, enhancing the dust removing effect.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A cooling fan comprising:

a housing including a base and a sidewall coupled to the base, with the sidewall defining a compartment, with the housing further including an air inlet, an air outlet, and a dust channel, with each of the air outlet and the dust channel having an inlet end and an outlet end, with the air inlet, the inlet end of the air outlet, and the inlet end of the dust channel being in communication with the compartment;

a stator coupled to the base of the housing;

an impeller rotatably coupled to the stator; and a control element including a driving circuit electrically connected to the stator and a rotating direction control circuit electrically connected to the driving circuit, with the inlet end of the air outlet and the inlet end of the dust channel located at and spaced along an inner periphery of the sidewall and separating the inner periphery into a first guiding wall section and a second guiding wall section, with the first guiding wall section having a guiding portion contiguous to the dust channel, with the guiding portion being in a form of an acute corner, with a first spacing between the guiding portion and a center of the impeller being smaller than a second spacing between the second guiding wall section and the center of the impeller, with the second guiding wall section including a bend contiguous to the dust channel, with the second spacing being between the bend and the center of the impeller.

2. The cooling fan as claimed in claim 1, with the outlet end of the air outlet including opposite first and second end edges, with the housing defining a first plane including the first and second end edges, with the impeller defining a second plane tangential to an outermost margin of the impeller adjacent to the air outlet, with the second plane parallel to and spaced from the first plane, with the compartment of the housing including an air outlet section and a pressure accumulating section on opposite sides of the second plane, with the air outlet section located between the first and second planes, and with the dust channel located in the pressure accumulating section.

3. The cooling fan as claimed in claim 2, with the dust channel extending in a direction at an acute angle, perpendicular, or parallel to the second plane.

4. The cooling fan as claimed in claim 1, with the outlet end of the air outlet including opposite first and second end edges, with the housing defining a first plane including the first and second end edges, with the impeller defining a second plane including the center of the impeller, with the second plane parallel to and spaced from the first plane, with the compartment of the housing including an air outlet section and a pressure accumulating section on opposite sides of the second plane, with the air outlet section located between the first and second planes, and with the dust channel located in the pressure accumulating section.

5. The cooling fan as claimed in claim 4, with the dust channel extending in a direction at an acute angle, perpendicular, or parallel to the second plane.

6. The cooling fan as claimed in claim 1, further comprising: a plurality of fins mounted in the outlet end of the air outlet of the housing.

7. The cooling fan as claimed in claim 1, further comprising: a cover coupled to the sidewall of the housing, with the cover including an opening aligned with the air inlet.

8. The cooling fan as claimed in claim 1, with the base of the housing including a plurality of auxiliary air inlets.

9. A cooling fan comprising:

a housing including a base and a sidewall coupled to the base, with the sidewall defining a compartment, with the housing further including an air inlet, an air outlet, and a dust channel, with each of the air outlet and the dust channel having an inlet end and an outlet end, with the air inlet, the inlet end of the air outlet, and the inlet end of the dust channel being in communication with the compartment;

a stator coupled to the base of the housing;

an impeller rotatable coupled to the stator;

a control element including a driving circuit electrically connected to the stator and a rotating direction control circuit electrically connected to the driving circuit, with the inlet end of the air outlet and the inlet end of the dust channel located at and spaced along an inner periphery of the sidewall and separating the inner periphery into a first guiding wall section and a second guiding wall section, with the first guiding wall section having a guiding portion contiguous to the dust channel, with the guiding portion being in a form of an acute corner, with a first spacing between the guiding portion and a center of the impeller being smaller than a second spacing between the second guiding wall section and the center of the impeller; and a dust guiding pipe attached to the dust channel.

10. The cooling fan as claimed in claim 9, with the outlet end of the air outlet including opposite first and second end edges, with the housing defining a first plane including the first and second end edges, with the impeller defining a second plane including the center of the impeller, with the second plane parallel to and spaced from the first plane, with the compartment of the housing including an air outlet section and a pressure accumulating section on opposite sides of the second plane, with the air outlet section located between the first and second planes, and with the dust channel located in the pressure accumulating section.

11. A housing for a cooling fan comprising:

a housing including a base and a sidewall coupled to the base, with the sidewall defining a compartment, with a shaft seat provided in the compartment and adapted to couple with an impeller, with the housing further including an air inlet, an air outlet, and a dust channel, with each of the air outlet and the dust channel having an inlet end and an outlet end, with the air inlet, the inlet end of the air outlet, and the inlet end of the dust channel being in communication with the compartment, with the inlet end of the air outlet and the inlet end of the dust channel located at and separating an inner periphery of the sidewall into a first guiding wall section and a second guiding wall section, with the first guiding wall section having a guiding portion contiguous to the dust channel, with the guiding portion being in a form of an acute corner, with a first spacing between the guiding portion and a center of the shaft seat being smaller than a second spacing between the second guiding wall section and the center of the shaft seat, with the second guiding wall section including a bend contiguous to the dust channel, with the second spacing being between the bend and the center of the shaft seat.

12. The housing for a cooling fan as claimed in claim 11, with the outlet end of the air outlet including opposite first and second end edges, with the housing defining a first plane including the first and second end edges, with the impeller defining a second plane tangential to an outermost margin of the impeller adjacent to the air outlet, with the second plane parallel to and spaced from the first plane, with the compartment of the housing including an air outlet section and a pressure accumulating section on opposite sides of the second plane, with the air outlet section located between the first and second planes, and with the dust channel located in the pressure accumulating section.

13. The housing for a cooling fan as claimed in claim 12, with the dust channel extending in a direction at an acute angle, perpendicular, or parallel to the second plane.

14. The housing for a cooling fan as claimed in claim 11, with the outlet end of the air outlet including opposite first and second end edges, with the housing defining a first plane including the first and second end edges, with the shaft seat defining a second plane including a center of the hub, with the second plane parallel to and spaced from the first plane, with the compartment of the housing including an air outlet section and a pressure accumulating section on opposite sides of the second plane, with the air outlet section located between the first and second planes, and with the dust channel located in the pressure accumulating section.

15. The housing for a cooling fan as claimed in claim 14, with the dust channel extending in a direction at an acute angle, perpendicular, or parallel to the second plane.

16. The housing for a cooling fan as claimed in claim 11, further comprising: a plurality of fins mounted in the air outlet of the housing.

17. The housing for a cooling fan as claimed in claim 11, further comprising: a cover coupled to the sidewall of the housing, with the cover including an opening aligned with the air inlet.

18. The housing for a cooling fan as claimed in claim 11, with the base of the housing including a plurality of auxiliary air inlets.

19. A housing for a cooling fan comprising:

a housing including a base and a sidewall coupled to the base, with the sidewall defining a compartment, with a shaft seat provided in the compartment and adapted to couple with an impeller, with the housing further including an air inlet, an air outlet, and a dust channel, with each of the air outlet and the dust channel having an inlet end and an outlet end, with the air inlet, the inlet end of the air outlet, and the inlet end of the dust channel being in communication with the compartment, with the inlet end of the air outlet and the inlet end of the dust channel located at and separating an inner periphery of the sidewall into a first guiding wall section and a second guiding wall section, with the first guiding wall section having a guiding portion contiguous to the dust channel, with the guiding portion being in a form of an acute corner, with a first spacing between the guiding portion and a center of the shaft seat being smaller than a second spacing between the second guiding wall section and the center of the shaft seat; and a dust guiding pipe attached to the dust channel.

20. The housing for a cooling fan as claimed in claim 19, with the outlet end of the air outlet including opposite first and second end edges, with the housing defining a first plane including the first and second end edges, with the impeller defining a second plane tangential to an outermost margin of the impeller adjacent to the air outlet, with the second plane parallel to and spaced from the first plane, with the compartment of the housing including an air outlet section and a pressure accumulating section on opposite sides of the second plane, with the air outlet section located between the first and second planes, and with the dust channel located in the pressure accumulating section.

* * * * *